United States Patent [19]

Rottier

[11] 4,066,932

[45] Jan. 3, 1978

[54] SATURABLE REACTOR DEVICE FOR OPERATING A DISCHARGE LAMP

[75] Inventor: Jacob Rottier, Eindhoven, Netherlands

[73] Assignee: U.S. Philips Corporation, New York, N.Y.

[21] Appl. No.: 661,055

[22] Filed: Feb. 25, 1976

[30] Foreign Application Priority Data

Mar. 5, 1975 Netherlands ..... 7502577

[51] Int. Cl.[2] ..... H05B 41/16; H05B 41/232

[52] U.S. Cl. ..... 315/244; 315/101; 315/239; 315/276; 315/DIG. 7

[58] Field of Search ..... 315/101, 105, 106, 239, 315/240, 244, DIG. 2, DIG. 5, DIG. 7, 276, 283

[56] References Cited

U.S. PATENT DOCUMENTS

| | | | |
|---|---|---|---|
| 3,235,769 | 2/1966 | Wattenbach | 315/DIG. 2 |
| 3,371,245 | 2/1968 | Hume | 315/240 |
| 3,758,818 | 9/1973 | Kaneda | 315/DIG. 7 |

*Primary Examiner*—Eugene R. LaRoche
*Attorney, Agent, or Firm*—Frank R. Trifari; Bernard Franzblau

[57] ABSTRACT

A device for starting and operating a discharge lamp, in particular a low pressure sodium vapor lamp. The device comprises two input terminals connected by means of a coil and the primary winding of an auto-transformer with the lamp connected in series with a capacitor between the ends of the transformer secondary winding. In the operating condition of the lamp the core of the transformer becomes saturated. The lamp is shunted by an electronic starter which assists, in the operating condition of the lamp, in the restart of the lamp during each half cycle of the AC electric supply.

9 Claims, 2 Drawing Figures

SATURABLE REACTOR DEVICE FOR OPERATING A DISCHARGE LAMP

The invention relates to a device provided with two input terminals, which are intended for connection to an AC voltage source, and with a gas and/or vapour discharge lamp as well as with electric circuit elements for starting and feeding that lamp. Both input terminals are interconnected by means of a series circuit of two electric coils, the first of which does not become saturated in the operating condition of a lamp — whereas the second coil does — two points of the second coil being connected by a series connection of the lamp and at least a capacitor.

A known device of the said type is, for example, described in United Kingdom Pat. No. 716,275.

A disadvantage of the known device is that this ballast unit requires a high voltage to be generated between the electrodes of the lamp for starting of the lamp is and that, furthermore, the lamp can be restarted after each half cycle of the voltage source. To ensure the foregoing, it is necessary to connnect the device either to a source of a comparatively high voltage, to transform the voltage considerably, or to exercise some restraint as regards the type of discharge lamp to be used in the circuit.

An object of the invention is to provide a device of the abovementioned type in which a low pressure sodium vapour discharge lamp can be used. As is known, such a lamp sometimes requires large voltages for starting and restarting, but it does not entail large voltages across the series circuit of the lamp and the capacitor.

A device according to the invention is provided with two input terminals intended for connection to an AC voltage source, and with a gas and/or vapour discharge lamp as well as with electric circuit elements for starting and feeding of the lamp. The two input terminals are interconnected by a series circuit of two electric coils of which the first does not become saturated in the operating condition of the lamp — whereas the second one does. Two points on the second coil being connected by a series connection of the lamp and at least a capacitor. The invention is characterized in that the lamp is a low pressure sodium vapour discharge lamp and in that this lamp is shunted by a starter comprising a semiconductor switch.

An advantage of a device-according to the invention is that the coils need not be rated such that a voltage suitable for starting the lamp is generated by them. The inductance may now be smaller because the starter which comprises the semiconductor switch attends to the starting of the lamp. A further advantage of a device according to the invention is that the required restarting voltage of the sodium lamp is further decreased due to the fact that the lamp current strength falls rapidly just prior to its zero crossing. Owing to this, a de-ionization of the sodium within the discharge tube is largely prevented, with the result that the required restarting voltage peak of the lamp need not be so large. The result of all this is inter alia that fewer electrical losses occur in the ballast circuit so that the efficiency of the total device, for example expressed in lumen per watt, can be relatively large.

It should be observed that it is in itself known to stabilize a low-pressure sodium vapour discharge lamp with an inductor, whereby the lamp is shunted by an auxiliary device which is provided with a semiconductor switch. See for example U.s. Pat. No. 4,023,066. However, a disadvantage of that known device is inter alia that therein the lamp current strength does not show the rapid fall just prior to its zero crossing. Furthermore, in that known device, a capacitor must as a rule be connected parallel to the input terminals to improve the power factor.

The series circuit of the capacitor and the lamp may for example be connected directly between the ends of the second coil.

In a preferred embodiment of a device according to the invention, the second coil forms part of an autotransformer in which the voltage across the total secondary winding in the no-load state is larger than the primary voltage and the lamp is connected in series with the capacitor between the ends of the total secondary winding.

An advantage of this preferred embodiment is that, as the series circuit of the capacitor and the lamp is connected to the second coil through an auxiliary winding, the voltage across the series circuit of the capacitor and the lamp may now be a little higher. This offers a greater freedom in the choice of the supply voltage and of the type of low-pressure sodium vapour discharge lamp to be used.

It is conceivable that the starter which comprises the semi-conductor switch remains operative also in the operating condition of the lamp. This starter might then, for example, remain in operation both at the beginning of a half cycle of the AC voltage source and at the end of that half cycle, i.e. during the time that its operating voltage proper is present across the lamp.

In a further preferred embodiment of a device according to the invention, the operating voltage of the lamp is lower during the second half of the half cycles of the AC voltage source so that, at this voltage, which also appears across the starter, the semiconductor switch of the starter is non-conducting.

That means that in the second part of a half cycle of the supply source, so when the operating voltage is across the lamp, the semiconductor switch does not function and the starter is not in operation.

An advantage of the latter preferred embodiment is that the auxiliary device, which comprises the semiconductor switch, is not unnecessarily in operation so that then no electrical losses occur in the auxiliary circuit. In addition to the foregoing it should be noted that it is, for example, conceivable that at the beginning of each half cycle of the supply voltage a restarting peak is generated to restart the lamp by means of the auxiliary device.

In a further improvement of the last mentioned preferred embodiment of a device according to the invention, the minimum lamp voltage at which the semiconductor switch becomes conductive is located between the minimum and the maximum required restarting voltage of the lamp.

An advantage of this preferred embodiment is that with a normally burning lamp the semiconductor switch need not attend to restarting, but in cases where the restarting voltage becomes very high, for example in the case of very old lamps or in very special circumstances, the semiconductor switch becomes operative again. This provides the advantage that the likelihood of radio interference — during the operating condition of the lamp — is consequently considerably less than if the auxiliary device with the semiconductor switch were permanently operative during the operating condition of the lamp.

The semiconductor switch of the auxiliary device may, for example, be a switch which is either provided with a control electrode or not. It might, for example, be a thyristor. To reduce its conduction time the latter might then be provided with an extinction auxiliary device.

In a following preferred embodiment of a device according to the invention the semiconductor switch of the starter is a transistor and the starter is provided with a rectifier bridge. The bridge input terminals are connected to electrodes of the lamp and the transistor is included in a branch which connects the output terminals of the rectifier bridge. invention, An advantage of this device is that both good and simple control of the switching of the semiconductor switch to the conducting and non - conducting state can be ensured and also that the starter can be operative in both odd and even half cycles of the supply voltage due to the action of the rectifier bridge.

The invention will be further explained with reference to the drawing in which.

Figure 1:
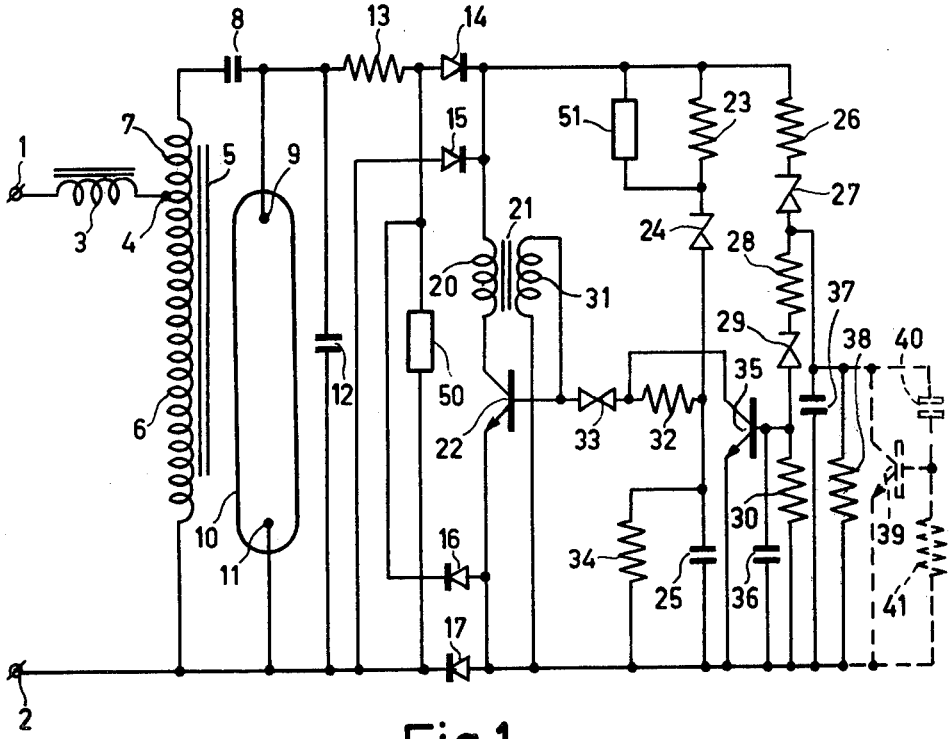
FIG. 1 is an electric circuit of a device according to the invention.

In FIG. 1 input terminals 1 and 2 are intended for connection to a power supply of approximately 220 volts, 50 Hz. Thee terminal 1 is connected to a first coil 3 which is not raised to saturation. The other end of the coil 3 is connected to a tap 4 of an autotransformer 5. This transformer is provided with a winding 6 (second coil) and a winding 7, the coil 6 being connected between point 4 and the terminal 2. The upper end of the winding 7 is connected to a capacitor 8. The other side of this capacitor 8 is connected to an electrode 9 of a low-pressure sodium vapour discharge lamp 10. The lamp 10 is only represented diagrammatically. A second electrode 11 of the lamp 10 is connected to the input terminal 2. A capacitor 12 shunts the lamp 10. Furthermore a resistor 13 is connected to electrode 9. The series circuit of the capacitor 12 and the resistor 13 is connected to the input terminals of a rectifier bridge provided with four diodes 14, 15, 16 and 17. The rectifier bridge 14 to 17 is provided with three centre branches:

The first centre branch consists of a series circuit of a primary winding 20 of a transformer 21 and a transistor 22.

The second centre branch of the rectifier bridge consists of a series circuit of a resistor 23, a zener diode 24 and a capacitor 25.

The third centre branch of the rectifier bridge 14 to 17 is composed of a series circuit of a resistor 26 a zener diode 27, a resistor 28, a zener diode 29, and a resistor 30.

The transformer 21 is provided with a further winding 31 whose ends are connected to the base and the emitter respectively of the transistor 22. Furthermore a junction between the zener diode 24 and the capacitor 25 is connected through a series arrangement of a resistor 32 and a double sided breakdown element 33 to the base of the transistor 22. The capacitor 25 is shunted by a resistor 34.

Furthermore the main electrode circuit of an auxiliary transistor 35 shunts the series circuit of resistor 32 and capacitor 25.

A junction between the zener diode 29 and the resistor 30 is connected to the base of the transistor 35. This resistor 30 is shunted by a capacitor 36.

Furthermore the series circuit of resistor 28, zener diode 29, and resistor 30 is shunted by a capacitor 37. In its turn capacitor 37 is shunted by a resistor 38. If one should want to keep the capacitance value of the capacitor 37 relatively small the resistor 38 might be shunted by a further auxiliary transistor 39. In this situation the collector and the base of this transistor are interconnected through a capacitor 40 and the base of this transistor 39 is connected to its emitter through a resistor 41.

Finally, the lamp 10 is shunted by a series circuit of the resistor 13 and a spike-suppressor 50. Also the resistor 23 is shunted by a similar spike-suppressor 51.

The circuit described operates as follows. When the terminals 1 and 2 are connected to the AC voltage source of 220 volts, 50 Hz, a current flows through the coils 3 and 6. The voltage induced in winding 7 by the current in coil 6 in winding 7, in winding 7 supplies, together with the voltage across the winding 6, a voltage across the series circuit of capacitor 8 and lamp 10. The voltage thus produced across the lamp 10 produces, at a sufficient instantaneous value and depending on the polarity of that voltage, a current in the circuit: 13, 14, 23, 24, 25, 17, or in the circuit: 15, 23, 24, 25, 16, 13. When consequently the capacitor 25 is charged to a voltage such that the breakdown value of the breakdown or threshold element 33 is obtained, the transistor 22 will become fully conductive by means of the transformer 21. This causes a current to flow in the first centre branch of the diode bridge, namely in the branch 20, 22. When this current has obtained a constant value, the drive for the transistor 22 is cut off. Owing to the known delay caused by the draining of charge carriers from the transistor, this transistor will not become non-conducting until somewhat later. The capacitor 25 is partly discharged through the resistor 34 during the time the transistor 22 is conducting. Owing to the fact that the transistor 22 beomes non-conducting the voltage across the capacitor 12, and consequently the voltage across the lamp 10, is raised. If the lamp 10 does not immediately start on this first rise in the voltage, the transistor 22 is rendered conducting again by a renewed charging of capacitor 25 and the above procedure repeats itself. This goes on until the lamp starts.

The device shown in FIG. 1 is rated in such a way that in the normal operating condition of the lamp 10, the part of the circuit designated by the references 13 and higher does not become operative any more.

Figure 2:
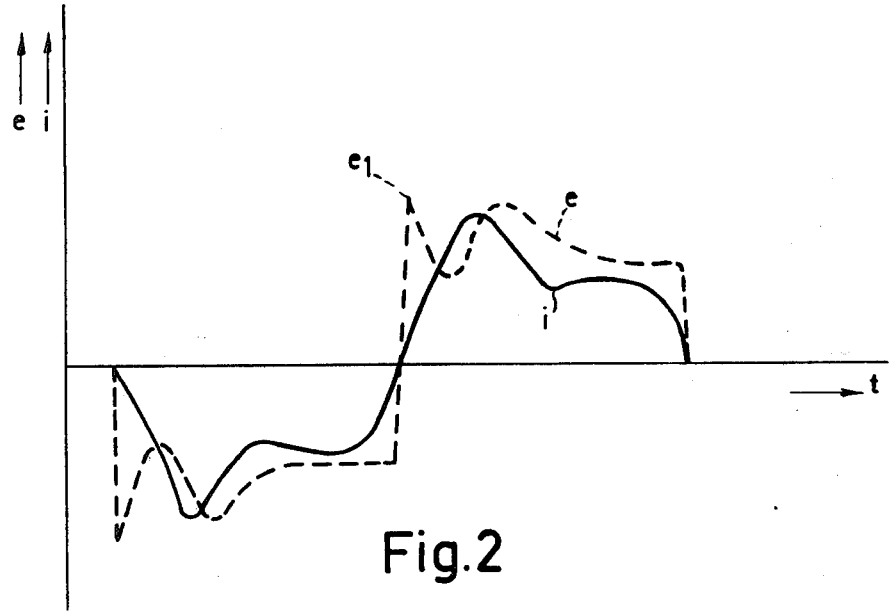
FIG. 2 shows the voltage between the electrodes of the lamp of FIG. 1 with respect to time as well as the current through that lamp with respect to time.

FIG. 2 shows the variation of the voltage $e$ across and the current $i$ through the lamp with respect to time $t$. Owing to the rapid decline of the current strength just prior to its zero crossing, it is ensured that the required restarting voltage for restarting the lamp is low. See for that purpose voltage peak $e_1$ in FIG. 2.

If now, however, the lamp 10 should refuse to start a situation is obtained, owing to the charging of the capacitor 37 through the resistor 26 and zener diode 27, in which, in the charged state of the capacitor 37, the voltage across so series circuit 28, 29, 30 becomes that high that a voltage is produced across the base of the transistor 35, which voltage keeps this transistor permanently conducting so that the capacitor 25 is in fact short-circuited. Consequently the transistor 22 becomes permanently non-conducting. So in that case the starter is put out of operation.

Another possibility is that if the lamp 10 is a somewhat older lamp or in the case of extraordinary circumstances, the restarting voltage supplied by the circuit 3, 5, 8 would be insufficient to restart the lamp 10 again every half cycle. In that case, also in the operating condition of the lamp 10, the voltage across the zener diode 24 will try to assume a value which is above its breakdown value. Consequently, the capacitor 25 is each time charged again in the operating condition. The result is that also in those very special circumtances — in the operating condition of the lamp 10 — the transistor 22 is made conducting now and then so that voltage peaks across the lamp 10 are produced which assist in restarting the lamp.

In an embodiment of the circuit of FIG. 1 the coil 3 has an inductance of about 0.6 Henry. The transformation ratio of the coils 6 and 7 of the transformer 5 is about 10 to 1. This transformer is saturated at a current strength of about 0.1 ampere. In the non-loaded condition the impedance ratio of the coils 3 and 6 is about 1 to 10 and in the loaded condition approximately 1 to 4. The capacitor 8 has a capacitance value of about 10.4 $\mu$ Farad. The resistors 13, 23, 26, 28, 32, 34, 30, 38 and 41 have the values of resistance of 150 Ohms, 33 kOhms, 100 kOhms, 10 kOhms, 47 Ohms, 470 kOhms, 10 kOhms, 150 kOhms and 100 kOhms respectively. The capacitance of the capacitors 25, 36, 37 and 40 is 15 n Fard; 3.3 n Fard; 4.7 $\mu$ Fard and 4.7 $\mu$ Farad respectively. The zener voltage of the zener diode 24 is about 168 Volts, that of zener diode 27 is about 150 Volts, and that of zener diode 29 is about 18 Volts. The breakdown voltage of the breakdown element 33 is about 32 Volts. The low-pressure sodium lamp 10 is a lamp of about 90 Watts having a starting voltage of about 600 Volts and an operating voltage of about 127 Volts. In normal circumstances the restarting voltage is about 150 Volts. In the embodiment described, the total efficiency of the device is about 120 lumen per watt. This relatively large efficiency is realized inter alia by the combination of the current waveform with a rapid decline prior to its zero crossing, and of an electronic auxiliary device for starting the lamp. The power factor of the device described is about 0.97.

The magnitude of the zener voltage of the zener diode 24 determines at what voltage across the electrodes 9, 11 the electronic auxiliary device assists in the supply of restarting voltages. In the case as described in FIG. 1 it is at a voltage of about 168 volts.

What is claimed is:

1. A device for starting and operating a low pressure sodium vapor discharge lamp comprising, two input terminals for connection to a source of AC voltage, first and second inductor coils, means connecting said first and second coils in a series circuit across said two input terminals, a capacitor, means connecting said discharge lamp and the capacitor in a series circuit across two terminals of the second coil, said first and second coils being designed so that the first coil does not saturate in the operating condition of the lamp, whereas the second coil does saturate during operation of the lamp, and means connecting a starter including a semiconductor switch in shunt with the discharge lamp.

2. A device as claimed in claim 1 wherein the second coil forms part of an autotransformer having a primary and a secondary winding and connected so that the voltage across the total secondary winding in the no-load condition exceeds the primary voltage, the lamp being connected in series with the capacitor between the ends of the total secondary winding.

3. A device as claimed in claim 1 wherein the semiconductor switch of the starter comprises a transistor, the starter further comprising a rectifier bridge whose input terminals are connected to electrodes of the lamp, and means connecting the transistor in a branch coupled to the output terminals of the rectifier bridge.

4. A device as claimed in claim 1 wherein the operating voltage of the lamp during the second half of the half cycles of the AC voltage source is of a lower value such that for this voltage, which is also present across the starter, the semiconductor switch of said starter is in its non-conducting state.

5. A device as claimed in claim 4, wherein the minimum lamp voltage at which the semiconductor switch becomes conductive is between the minimum and the maximum required restarting voltage of the lamp.

6. A starting and operating circuit for an electric discharge lamp comprising, a pair of input terminals for connection to a source of AC voltage, a ballast coil, a saturable reactor coil, means connecting said ballast coil and said saturable reactor coil in a series circuit across said input terminals, a capacitor, means connecting said discharge lamp and said capacitor in a series circuit across a part of said saturable reactor coil, said ballast coil being designed so that it does not saturate at the lamp operating current, said saturable reactor coil being saturable at the lamp operating current thereby to deform the lamp current waveform so it exhibits a rapid decline just prior to its zero crossing, and means connecting a semiconductor switch in shunt with the discharge lamp for generating a high voltage pulse to start the lamp.

7. A circuit as claimed in claim 6, wherein the lamp starting voltage is substantially higher than its normal operating voltage, and said ballast coil and said saturable reactor coil are designed to have a voltage rating below the lamp starting voltage.

8. A circuit as claimed in claim 6, further comprising a second capacitor connected across the lamp electrodes, said second capacitor and said semiconductor switch cooperating together to provide the primary means for generating said high voltage starting pulse for the discharge lamp.

9. A circuit as claimed in claim 6 further comprising, a resistor, a voltage breakdown element and a second capacitor connected in a series circuit across the main current terminals of the semiconductor switch, means coupling said second capacitor to a control electrode of the semiconductor switch to control the operation thereof, and means including a second voltage breakdown element coupled to said second capacitor to alter the second capacitor charge rate when the voltage across the second breakdown element exceeds its threshold level.

* * * * *